United States Patent [19]

Uetake et al.

Best Available Copy

[11] 4,137,188

[45] Jan. 30, 1979

[54] MAGNETIC TONER FOR ELECTROPHOTOGRAPHY

[76] Inventors: Shigeru Uetake; Katsutoshi Tozawa; Keiji Sato, all of No. 1, Sakura-machi, Hino City, Tokyo, Japan

[21] Appl. No.: 874,151

[22] Filed: Feb. 1, 1978

Related U.S. Application Data

[63] Continuation of Ser. No. 739,130, Nov. 5, 1976, abandoned.

[30] Foreign Application Priority Data

Nov. 7, 1975 [JP] Japan ..... 50/134570

[51] Int. Cl.$^2$ ..... G03G 9/14

[52] U.S. Cl. ..... 252/62.1 P; 96/1 SD; 252/62.54; 264/117; 427/213; 264/15

[58] Field of Search ..... 252/62.1 R, 62.1 P, 252/62.54; 96/1.0 SD; 264/15, 117; 427/213

[56] References Cited

U.S. PATENT DOCUMENTS

| | | | |
|---|---|---|---|
| 3,196,032 | 7/1965 | Seymour | 252/62.1 P |
| 3,627,682 | 12/1971 | Hall et al. | 252/62.1 P |
| 3,639,245 | 2/1972 | Nelson | 252/62.1 P |
| 3,645,770 | 2/1972 | Flint | 96/1 SD |
| 3,674,736 | 7/1972 | Lerman et al. | 252/62.1 P |
| 3,909,258 | 9/1975 | Kutz | 96/1 SD |

FOREIGN PATENT DOCUMENTS

| | | | |
|---|---|---|---|
| 2538112 | 3/1976 | Fed. Rep. of Germany | 252/62.1 P |

*Primary Examiner*—John T. Goolkasian
*Attorney, Agent, or Firm*—James E. Nilles

[57] ABSTRACT

An insulating magnetic toner useful as a one component developer for electro-photography consisting essentially of a ferro-magnetic material, a resin and a charge controlling agent. The preferred toner mixture has an average particle size in the range from about 7 to about 30 μm and is substantially free of particles having a size smaller than 1 μm. The toner is preferably prepared by mixing a ferromagnetic material, a resin and a charge controlling agent, heat kneading, cooling and then granulating the mixture to form fine particles, contacting the pacticles with a hot gas of a temperature higher than the toner softening point and lower than 500° C., to fuse particles smaller than about 1 μm to larger particles, cooling and selecting the particles of an average particle size of about 7 to about 30 μm.

6 Claims, No Drawings

MAGNETIC TONER FOR ELECTROPHOTOGRAPHY

REFERENCE TO RELATED CO-PENDING APPLICATION

This is a continuation application of U.S. Ser. No. 739,130, filed Nov. 5, 1976, now abandoned.

This invention relates to a magnetic toner for electrophotography having ferromagnetic and insulating characteristics, which is used as a main component of a one-component type dry developer for electrophotography.

As the dry developer for developing an electrostatic latent image formed on a photosensitive material for electrophotography, there is known a two-component type developer comprising a carrier and a toner, which is used for the magnetic brush developing method or cascade developing method. There also is known a one-component type developer comprising a toner alone, which is used for the touch down method, impression method, hair brush method, powder cloud method or the magnedynamic method disclosed in West Germany Laid-Open Patent Specification No. 2,313,297. The developer that is used in the magnedynamic method comprises as the main component a conductive ferromagnetic toner. Although the resulting toner image is excellent, if the toner image formed on an electrophotographic photosensitive material is transferred to, for example, plain paper, the sharpness is degraded and a good image is hardly obtained. West German Laid-Open Patent Specification No. 2,538,112. shows a developing method using a one-component type developer comprising as the main component a magnetic tone overcoming the above defect. More specifically, this developer comprises as the main component a magnetic toner formed by dispersing uniformly in a binder resin a magnetic material which is a conductor or semiconductor having electrons as free charge carriers and has a frictional charging characteristic negative to the binder resin, optionally together with a pigment or dye according to need and adding, if desired, a flow modifier to the dispersion. The developer is composed of magnetic toner particles obtained by dispersing the above magnetic material and the pigment or dye very uniformly in the resin. These toner particles are formed so that a number of surfaces of the magnetic material particles are exposed to the toner particle surfaces or very thin layers are formed on the exposed surfaces of the magnetic materials to such an extent that frictional charging among the toner particles can be accomplished conveniently. Positive and negative charges are imparted to the toner particles by frictional charging among the toner particles, and spikes of the toner particles are formed by a magnet for development and a good developing action is manifested. The developer of this type can be used for not only an electrophotographic photosensitive material of the negative charging characteristic such as zinc oxide but also an electrophotographic photosensitive material of the positive charging characteristic such as selenium.

Magnetic toners of this type have heretofore been prepared by, for example, the spray-drying method using a solvent and the pulverizing granulation method using no solvent. In general, the pulverizing granulation method is popularly adopted in the art.

This pulverizing granulation method comprises preliminarily mixing a magnetic material, a resin and a pigment or dye by means of a mixer such as a ball mill, kneading the mixture by means of two rolls, an extruder or a kneader, cooling the kneaded mixture and then pulverizing and sieving the mixture. In the so prepared magnetic toner, the surfaces of the magnetic material particles are substantially exposed to the toner particle surfaces to such an extent as will not interfere with frictional charging among the particles and the toner particles have such a property that sufficient charging is manifested by mutual friction among the particles. Accordingly, if this pulverizing granulation method is applied to production of magnetic toners as intended in the present invention, very fine powdery particles having a size smaller than about 1.0 μm which are formed at the pulverizing step (these fine particles include not only particles having properties as the toner but also particles free of properties as the toner, namely particles of the resin, the magnetic material and the pigment or dye), adhere electrostatically to one another or to larger particles, and they cannot be separated by classification or the like. If the magnetic toner that can be charged by mutual friction among particles is used repeatedly for a powder image transfer type electrophotographic copying machine in the state containing such fine particles, these fine particles adhere to the surface of the electrophotographic photosensitive material to cause reduction of the sensitivity and the ghost phenomenon, and finally, no image can be formed at all. This is a fatal defect of the above-mentioned pulverizing granulation method.

It is therefore a primary object of the present invention to provide a magnetic toner that can be charged by mutual friction of toner particles, which is used for a one-component type dry developer for powder-developing an electrostatic latent image formed on an electrophotographic photosensitive or insulating material and which does not reduce the sensitivity of the photosensitive material to degrade the image quality.

Another object of the present invention is to provide a magnetic toner for electrophotography which does not cause extreme reduction of the sensitivity or extreme degradation of the image quality even if it is used for an image transfer type electrophotographic copying machine.

In accordance with the present invention, these objects can be attained by a magnetic toner for electrophotography having an insulating characteristic as a whole, which comprises a ferromagnetic material and a resin as main components, wherein the magnetic toner is formed so that surfaces of particles of the ferromagnetic material are substantially exposed to the surface of the toner particles, the average particle size of the toner particles is in the range of from 7 to 30 μm and the magnetic toner is substantially free of particles having a size smaller than 1 μm. Said average particle size of the toner particles is conducted from relation between the toner particle diameter and weight of said particles.

The insulating magnetic toner of the present invention is produced according to the method which comprises mixing magnetic particles, a resin and a charge controlling agent to form a mixture, heat kneading, cooling and granulating the mixture into fine particles, contacting the fine particles with a hot gas to fuse particles smaller than about 1 μm to larger particles, cooling the fine particles contacted with the hot gas, and selecting particles of an average particle size in the range of 7 to 30 μm. The temperature of the hot gas used to contact the fine particles is from the softening point of the toner to about 500° C.

More specifically, the toner of the present invention is a toner comprising a ferromagnetic material and a resin, in which surfaces of particles of the ferromagnetic material are substantially exposed to the surfaces of the toner particles so as to cause frictional charging among the toner particles and in which the toner particles have an average particle size of 7 to 30 μm and the magnetic toner is substantially free of fine particles having a size smaller than 1 μm. If this magnetic toner of the present invention is employed as a developer for electrophotography, a carrier need not be used at all and hence, degradation of the image quality caused by degradation of the carrier or change of the composition in the developer need not be taken into consideration. Further, when the magnetic toner of the present invention is used for an electrophotographic copying machine of the type where image transfer is repeated, occurrence of undesirable phenomena caused by the presence of fine particles in the toner, such as reduction of the sensitivity of the photosensitive material and degradation of the image quality, can be effectively prevented.

As pointed out hereinbefore, the magnetic toner of the present invention has an average particle size in the range of from 7 to 30 μm, and it is substantially free of fine particles having a size smaller than 1.0 μm. If the average particle size is larger than 30 μm, the resulting image is extremely coarse and the toner cannot be practically used for formation of images. Accordingly, the objects of the present invention cannot be attained by such toner. In the present invention, it is preferred that the toner be substantially free of particles having a size exceeding 50 μm. If the average particle size is smaller than 7 μm, worm-like agglomerates of toner particles are formed at the toner-preparing step or the image-forming step, and as a result, the flowability of toner particles is degraded and the image quality is reduced. Accordingly, the objects of the present invention cannot be attained by the present invention, if fine particles having a size smaller than 1 μm are contained in the magnetic toner, even when the above requirement of the particle size is satisfied. As pointed out hereinbefore, these fine particles are strongly attracted and deposited on the surface of the electrophotographic photosensitive material to degrade the sensitivity of the photosensitive material and the image quality. Accordingly, the objects of the present invention cannot be attained by a magnetic toner containing such fine particles.

In short, the defects such as mentioned above can be overcome for the first time by the use of a magnetic toner satisfying the above requirements of the particle size specified in the present invention, and it becomes possible to form excellent images according to electrophotography and the like electro-static recording.

The magnetic toner of the present invention comprises as main components a resin, a colorant and a finely divided ferromagnetic material.

Various thermoplastic resins are used as the resin component for imparting an insulating characteristic to the toner. As the thermoplastic resin, there are advantageously employed homopolymers and copolymers obtained by polymerizing monomers such as mentioned below singly or in combination. As the monomers, there can be mentioned, for example, styrenes such as styrene and p-chlorostyrene, vinylnaphthalenes, vinyl esters such as vinyl chloride, vinyl bromide, vinyl fluoride, vinyl acetate, vinyl propionate, vinyl benzoate and vinyl butyrate, esters of α-methylene aliphatic monocarboxylic acids such as methyl acrylate, ethyl acrylate, n-butyl acrylate, isobutyl acrylate, dodecyl acrylate, n-octyl acrylate, 2-chloroethyl acrylate, phenyl acrylate, methyl α-chloroacrylate, methyl methacrylate, ethyl methacrylate and butyl methacrylate, acrylonitrile, methacrylonitrile, acrylamide, vinyl ethers such as vinylmethyl ether, vinylisobutyl ether and vinyl-ethyl ether, vinyl ketones such as vinylmethyl ketone and vinylhexyl ketone, and N-vinyl compounds such as N-vinyl-pyrrole, N-vinylcarbazole, N-vinylindole and N-vinylpyrrolidone. Further, mixtures of such vinyl polymers and mixtures of such vinyl type resins with non-vinyl type thermoplastic resins such as rosin-modified phenol-formalin resins, oil-modified epoxy resins, polyurethane resins, cellulose resins and polyether resins can also be employed. Among these resins, vinyl type resins having a glass transition point higher than 20° C. and a weight average molecular weight of about 1000 to about 500000 are used especially effectively for the toner of the present invention.

When a developed toner image is fixed by using a hot roller, a resin composed mainly of a styrene type resin is preferably employed. In this case, it is preferred that the content of the styrene component in the resin be at least 25% based on the total resin weight. The parting property of the toner to the fixing roller is closely concerned with the content of the styrene component, and there is a tendency that as the styrene content is reduced, the parting property of the toner to the fixing roller is degraded.

A suitable pigment or dye can be used as the colorant. For example, there are used carbon black, Nigrosine dyes, Aniline Blue, Calco Oil Blue, Chrome Yellow, Ultramarine Blue, Du Pont Oil Red, Quinoline Yellow, Methylene Blue Chloride, Phthalocyanine Blue, Malachite Green Oxalate, Rose Bengal, and mixtures thereof. It is necessary that the colorant must be incorporated into the toner in an amount sufficient to color the toner so as to form a visible image by development. For example, when carbon black is used, it is preferred that carbon black be used in an amount of about 1 to about 10 parts by weight per 100 parts by weight of the resin component of the toner. Among the foregoing colorants, carbon black is effectively used. Especially when carbon black which has been subjected to the oxidation treatment is employed, since it has a charge-controlling characteristic, use of a particular charge-controlling agent is omitted. Accordingly, use of such carbon black is especially preferred and advantageous. Since carbon black has an electric conductivity, if it is incorporated in too large an amount, the insulating property of the toner is reduced. Therefore, it is not preferred to use carbon black in too large an amount.

As the finely divided ferromagnetic material, there is employed a material which is strongly magmetized by a magnetic field in the direction thereof. For example, there are employed alloys and compounds containing ferromagnetic elements, e.g., iron, cobalt and nickel, such as ferrite and magnetite, alloys which are free of ferromagnetic elements but can also be rendered ferromagnetic by a suitable heat treatment, such as manganese-copper-aluminum alloys, manganese-copper-tin alloys and other so-called Heusler's alloys, and chromium dioxide. When such ferromagnetic material is incorporated in the toner, it is preferred that the particle size be in the range of from about 0.1 to about 1 μm and the amount incorporated be about 20 to about 70 parts by weight per 100 parts by weight of the toner. Since the ferromagnetic material is ordinarily electrically conductive as well as carbon black, in order to maintain the insulating property of the toner to a prescribed level, it is not preferred to incorporate the ferromagnetic material in too large an amount. If the ferromagnetic substance also acts as a colorant, a particular colorant need not be incorporated.

The toner of the present invention may further comprise various toner additives according to need. Certain dyes or pigments may be added as charge-controlling agents so as to control the charge of the toner appropriately. As such charge controlling agent, there can be mentioned, for example, dyes disclosed in Japanese Patent Application Publication No. 2427/66, such as Fetschwartz HBN (Color Index No. 26150), Alcohol Soluble Nigrosine (Color Index No. 50415), Sudan Chief Schwartz (Color Index No. 26150), Brilliant Spirit Schwartz TN (product of Bayer AG), Zapon Schwartz X (product of Hoechst AG), Ceres Schwartz (R) G (product of Bayer AG), Chromogene Schwartz ETCO (Color Index No. 14645) and Azo Oil Black R (R) (product of National Aniline Co. ), and metal-containing dyes such as Phthalocyanine Blue. These charge-controlling agents may be added in the form of salts of higher fatty acids so as to improve their compatibility with the resin component of the toner. Alternately, compatibility-improving agents may be added. In case of the toner to be applied to an imageforming method in which fixation is accomplished by a heating roller, there may be added materials having a parting effect to the fixing roller, for example, metal salts of fatty acids such as cadmium stearate, barium stearate, zinc oleate and cobalt palmitate, polyethylene and polypropylene having a relatively low molecular weight, higher fatty acids having at least 28 carbon atoms, and natural and synthetic paraffins. When the resin component of the toner contains a relatively brittle substance, a plasticizer or the like may be added as a modifier.

The components of the toner of the present invention are selected appropriately from the above-exemplified various substances. Especially, the resin component is appropriately chosen according to the intended use after due consideration of such factors as the compatibility with the ferromagnetic material and the pigment or dye, the frictional chargeability of the ferromagnetic material and resin component, the adaptability to mechanical pulverization and the fixing property under heating.

When the magnetic toner of the present invention is used as a developer, since it does not contain a carrier, its flowability is not good. In general, as the mutual frictional charging property is high, the flowability is low. Accordingly, when the toner of the present invention has no sufficient flowability, it is preferred to add a flow modifier such as silica powder in an amount of up to about 1% by weight.

The magnetic toner of the present invention can be prepared according to the pulverizing granulation method customarily adopted in the art. For example, starting materials such as the resin, colorant and finely divided ferromagnetic material, optionally with additives such as a charge-controlling dye, are preliminarily mixed in a ball mill for a relatively short time, for instance, for 24 hours or a shorter period, and the mixture is heated and kneaded over a period of about 20 to about 60 minutes at a temperature lower than the softening point of the resin component, ordinarily at 60° to 120° C. Then, the kneaded mixture is cooled, solidified and pulverized, whereby the intended toner is prepared.

In the magnetic toner of the present invention in which charging is caused by mutual friction among the toner particles, fine particles are formed in the pulverizing granulation process, and they electrostatically adhere strongly to one another or to larger particles and it is difficult to remove such fine particles by classification. In order to solve this problem, it is most preferred to adopt a method in which these fine particles are removed by fusing them by hot air heating using a spray drier or the like at the higher temperature than the toner softening point and lower temperature than about 500° C.

A magnetic toner satisfying the particle size requirements of the present invention can be prepared by dissolving and dispersing a resin, a pigment and a finely divided magnetic material optionally with a charge-controlling dye into toulene, acetone or a mixed solvent thereof and spray-drying the resulting dispersion. According to this method, it is possible to form a magnetic toner free of fine particles and having a very narrow particle size distribution range. However, this method requires additional steps for recovering the solvent and preventing explosion or environmental pollution. Moreover, the toner includes a great number of voids formed by evaporation of the solvent. Accordingly, it is most preferred that the magnetic toner of the present invention be prepared according to the above-mentioned pulverizing granulation method.

When development is carried out by using a developer formed by incorporating a flow modifier into the magnetic toner of the present invention, there is advantageously adopted a developing apparatus shown in U.S. patent application Ser. No. 608,274 comprising a hopper for feeding a developer comprising a magnetic toner and up to 1% by weight of a flow modifier such as silica powder, a fixed drum-like magnet member including N and S magnets alternately arranged and a sleeve rotating around said fixed drum-like magnet member and disposed at a position spaced by about 1 mm from the hopper, in this developing apparatus, a magnetic toner is fed onto the sleeve from the hopper and a layer having a thickness of about 1 mm which corresponds to the spacing between the hopper and the sleeve is formed on the sleeve, and while the toner layer is transferred on the sleeve, spikes are formed and fall in contact with a photosensitive material drum spaced from the sleeve by about 1.5 mm and rotating in the direction opposite to the rotation direction of the sleeve, whereby development is accomplished.

When the development is thus conducted by using the magnetic toner of the present invention, a device for mixing the toner with a carrier or a device for controlling the mixing ratio need not be provided, and the structure of the development system can be simplified and the development can be accomplished with economical advantages. Moreover, frictional charging takes place at any points in the hopper or on the sleeve among the toner particles. Therefore, frictional charging is caused very effectively and an excellent image is formed.

The present invention will now be described in detail by reference to the following Examples that by no means limit the scope of the invention.

EXAMPLE 1

In a ball mill, 35 parts of an epoxy resin having a softening point of 97 to 103° C. (Epikote 1004), 1.5 parts of Nigrosine SSB and 65 parts of a powdery magnetic material (Mapico Black BL-500) were pulverized, mixed and dispersed for 12 hours, and the mixture was sufficiently kneaded on two heated rolls. The kneaded mixture was cooled, roughly pulverized and finely pulverized by a jet mill. The pulverized toner was blown into a commercially available bench-scale spray drier (Mobile Minor manufactured by Niro Co.) by using an air jet nozzle and was instantaneously heated by hot air maintained at 100, 125, 150, 200 or 250° C. Thus, 5 samples were prepared. These samples were classified by using a zigzag classifier to obtain toners having an average particle size of 15 μm, and 0.2% by weight of silica powder was added as a flow modifier to these toners to form 5 kinds of developers (samples Nos. 1 to 5). A comparative sample (sample No. 6) was prepared in the same manner as above except that the instantaneous heating by the spray drier was carried out at 400° C. Moreover, comparative samples (samples Nos. 7 and 8) were prepared in the same manner as above except that the spray drier heating was carried out at 200° C. and classification was conducted by the zigzag classifier so that average particle sizes were adjusted to 40 μm and 5 μm, respectively. Another comparative sample (sample No. 9) was prepared in the same manner as above except that the spray drier heat treatment was not conducted.

These samples (samples Nos. 1 to 5) and comparative samples (samples Nos. 6 to 9) were tested by a centrifugal photo-sediment meter (manufactured by Seishin Kigyo) to determine contents of fine particles having a size smaller than about 1.0 μm. Copying operation was conducted repeatedly in a developing apparatus of the above-mentioned type attached to an electrophotographic copying machine (Model UBIX 800 manufactured by Konishiroku Photo Industry Co.) by using the above-mentioned samples and zinc oxide photosenstive paper as the photosensitive material, and the frequency of the copying operations where visible images could be formed was determined with respect to each sample. Further, the image quality was evaluated according to the following scale:

○ : good
Δ : middle
X : bad

Obtained results are shown in Table 1.

Table 1

| Sample No. | Heating Temperature (° C) | Average Particle Size (μm) | Content (% by weight) of Fine Particles having Size Smaller than 1.0 μm | Frequency (times) of Image-Formable Copying Operation | Image Quality |
|---|---|---|---|---|---|
| 1 | 100 | 15 | 0.10 | 200 | ○ |
| 2 | 125 | 15 | 0.03 | 400 | ○ |
| 3 | 150 | 15 | 0.01 | 500 | ○ |
| 4 | 200 | 15 | 0.00 | 1000 | ○ |
| 5 (comparison) | 250 | 15 | 0.00 | 1000 | ○ |
| 6 (comparison) | 400 | 15 | 0.00 | 200 | Δ |
| 7 (comparison) | 200 | 40 | 0.00 | 1000 | X |
| 8 (comparison) | 200 | 5 | 0.00 | 500 | X |
| 9 | — | 15 | 5.0 | 10 | X |

EXAMPLE 2

By means of a two-roll mill, 45 parts of an epoxy resin having a softening point of 80° C. (Epikote 1002), 1.5 parts of Oil Black BS, 55 parts of Mapico Black BL-100 and 1.5 parts of carbon black (MA-100) were sufficiently mixed and kneaded. The kneaded mixture was cooled, roughly pulverized and finely pulverized by a hammer mill. The pulverized toner was divided into 6 portions. Five portions were heat-treated at 5 different temperatures of 100, 125, 150, 200 and 250° C., respectively, by using the spray drier in the same manner as in Example 1, and the resulting toners were classified by a zigzag classifier so as to attain an average particle size of 27 μm and 0.2% by weight of silica powder was added to each toner, whereby 5 kinds of developers (samples Nos. 10, 11, 12, 13 and 14) were prepared. Separately, a comparative sample (sample No. 15) was prepared from the remaining portion of the pulverized toner in the same manner as above except that the heat treatment by the spray drier was not conducted. These samples were treated in the same manner as in Example 1 to obtain results shown in Table 2.

Table 2

| Sample No. | Heating Temperature (° C) | Average Particle Size (μm) | Content (% by weight) of Fine Particles having Size Smaller than 1.0 μm | Frequency (times) of Image-Formable Copying Operation | Image Quality |
|---|---|---|---|---|---|
| 10 | 100 | 27 | 0.07 | 300 | ○ |
| 11 | 125 | 27 | 0.02 | 450 | ○ |
| 12 | 150 | 27 | 0.01 | 800 | ○ |
| 13 | 200 | 27 | 0.00 | 1000 | ○ |
| 14 (comparison) | 250 | 27 | 0.00 | 1000 | ○ |
| 15 | — | 27 | 2.0 | 10 | X |

EXAMPLE 3

By means of a compression kneader, 40 parts of a styrene-acrylic copolymer (Himer SBM manufactured by Sanyo Kasei K.K.), 2 parts of Oil Black SO, 60 parts of Mapico Black BL-500 and 1.5 parts of carbon black (MA-100) were sufficiently mixed and kneaded without performing preliminary mixing. The kneaded mixture was cooled and pulverized. The pulverized toner was divided into 6 portions. Five portions were heat-treated at 5 different temperatures of 130, 150, 180, 230 and 300° C., respectively, by using the spray drier in the same manner as in Example 1, and the resulting toners were classified by a zigzag classifier so as to attain an average particle size of 8 μm and 0.1% by weight of silica powder was added to each toner, whereby 5 kinds of developers (samples Nos. 16, 17, 18, 19, and 20) were prepared. Separately, a comparative sample (sample No. 21) was prepared from the remaining portion of the pulverized toner in the same manner as above except that the heat treatment by the spray drier was not conducted. These samples were tested in the same manner as in Example 1 to obtain results shown in Table 3.

Table 3

| Sample No. | Heating Temperature (° C) | Average Particle Size (μm) | Content (% by weight) of Fine Particles having Size Smaller than 1.0 μm | Frequency (times) of Image-Formable Copying Operation | Image Quality |
|---|---|---|---|---|---|
| 16 | 120 | 8 | 0.10 | 200 | ○ |
| 17 | 150 | 8 | 0.05 | 320 | ○ |
| 18 | 180 | 8 | 0.02 | 500 | ○ |
| 19 | 230 | 8 | 0.00 | 1000 | ○ |
| 20 (comparison) | 300 | 8 | 0.00 | 1000 | ○ |
| 21 | — | 8 | 2.00 | 10 | X |

From the results shown in Tables 1 to 3, it will readily be understood that samples having an average particle size of 7 to 30 μm, from which fine toners having a size smaller than 1.0 μm have been removed by a spray drier or the like, are much improved over comparative samples in which the average particle size is outside the range of 7 to 30 μm and/or fine particles having a size smaller than 1.0 μm are contained in substantial amounts, with respect to the image quality and the frequency of the image-formable copying operations.

EXAMPLE 4

By a Henschel mixer, 35 parts of a 10:90 copolymer of diethylaminoethyl methacrylate and styrene having a softening point of 120° to 125° C. and 65 parts of Mapico Black BL-500 were pulverized and dispersed, and the mixture was then kneaded by a kneader and granulated in the same manner as in case of sample No. 19 of Example 3. The resulting toner was divided into three portions, which were then mixed with 0.2% by weight of Aerosil R-972 as a flow modifier, 0.01% by weight of Aerosil Aluminum Oxide as a flow modifier and 0.05% by weight of Aerosil 200 as a flow modifier, respectively, to form three kinds of developers.

Separately, 8 parts of a 20:80 copolymer of diethylaminoethyl methacrylate and styrene having a softening point of 120° C., 32 parts of Himer SBM-73 having a softening point of 120° to 130° C., 60 parts of Mapico Black BL-100 and 1.5 parts of Carbon Black MA-8 were pulverized and dispersed by a Henschel mixer, and the pulverized mixture was kneaded and granulated in the same manner as in case of sample No. 19 of Example 3 to form a developer.

By using the so prepared 4 developers, transfer images were repeatedly formed by using the same apparatus and procedures as in Example 1. In each developer, no substantial degradation of the image quality was observed on the 1000th copied image.

We claim:

1. A process of making an insulating magnetic toner, useful as a one component developer for electrophotography comprising the steps of mixing ferromagnetic particles, a thermoplastic resin and a charge controlling agent, heat kneading, cooling and granulating the resulting mixture into fine particles, contacting the fine particles with a hot gas of a temperature higher than the toner softening point and lower than 500° C. for a length of time sufficient so that particles smaller than about 1 μm in size fuse to larger particles thereby reducing the content in percent by weight of the toner particles smaller than about 1 μm in size to a range between 0.10 and 0.00, cooling the particles and then selecting the particles having an average particle size in the range of about 7 to about 30 μm.

2. A process of making an insulating magnetic toner according to claim 1, wherein the toner contains about 20 to 70 parts of ferromagnetic material per 100 parts by weight of the toner.

3. A process of making an insulating toner according to claim 1, wherein the toner contains a colorant.

4. An insulating magnetic toner useful as a one component developer for electrophotography prepared by a process comprising the steps of mixing ferromagnetic particles, a thermoplastic resin and a charge controlling agent, heat kneading, cooling and granulating the resulting mixture into fine particles, contacting the fine particles with a hot gas of a temperature higher than the toner softening point and lower than 500° C. for a length of time sufficient so that particles smaller than about 1 μm in size fuse to larger particles thereby reducing the content in percent by weight of the toner particles smaller than about 1 μm in size to a range between 0.10 and 0.00 cooling the particles and selecting the particles having an average particle size in the range of about 7 to about 30 μm.

5. An insulating magnetic toner according to claim 4, wherein the toner contains about 20 to 70 parts of ferromagnetic material per 100 parts by weight of the toner.

6. An insulating magnetic toner according to claim 4, wherein the toner contains a colorant.

* * * * *